US007163165B2

(12) United States Patent
Paul et al.

(10) Patent No.: US 7,163,165 B2
(45) Date of Patent: Jan. 16, 2007

(54) DE-COKING TOOL

(75) Inventors: Wolfgang Paul, Bad Schwartau (DE); Dirk Heidemann, Schwerte (DE); Maciej Bareikowski, Bochum (DE)

(73) Assignee: Ruhrpumpen GmbH, Witten (DE)

( * ) Notice: Subject to any disclaimer, the term of this patent is extended or adjusted under 35 U.S.C. 154(b) by 0 days.

(21) Appl. No.: 10/484,571

(22) PCT Filed: Jul. 23, 2002

(86) PCT No.: PCT/EP02/08191

§ 371 (c)(1),
(2), (4) Date: Jul. 15, 2004

(87) PCT Pub. No.: WO03/014261

PCT Pub. Date: Feb. 20, 2003

(65) Prior Publication Data

US 2004/0238662 A1 Dec. 2, 2004

(30) Foreign Application Priority Data

Jul. 23, 2001 (DE) ..... 101 34 951
Jul. 30, 2001 (DE) ..... 101 36 597

(51) Int. Cl.
*B02B 1/00* (2006.01)
*B02C 19/00* (2006.01)
*B08B 3/00* (2006.01)

(52) U.S. Cl. ..... 241/39; 241/101.1; 134/168 R

(58) Field of Classification Search ..... 241/39, 241/101.1, 101.01; 134/168 R, 167 R, 169 R
See application file for complete search history.

(56) References Cited

U.S. PATENT DOCUMENTS 5,050,995 A * 9/1991 Lucore, II ..... 366/136
5,417,811 A * 5/1995 Malsbury ..... 202/241
2004/0238408 A1* 12/2004 Malsbury ..... 208/131

* cited by examiner

*Primary Examiner*—Faye Francis
(74) *Attorney, Agent, or Firm*—Bachman & LaPointe, P.C.

(57) ABSTRACT

A tool for disintegrating coke has a housing attached to a drill stem in operation, at least one nozzle for cutting and one nozzle for drilling of coke, and at least one valve for closing and opening the nozzles, wherein the tool is adapted to have two different operating states and wherein the at least one valve closes off the cutting nozzles in the drilling operating state, while the drilling nozzles are closed off by the at least one valve in the cutting operating state, and wherein the housing, the valve and the nozzles are adapted so that water may flow unhindered from the drill stem through the housing and the valve and through the nozzles not closed off by the valve, wherein, the nozzles to be closed, for each chosen operating state, are closed off by the balls of a ball valve. An arrangement for operating the valve is arranged above the nozzles.

13 Claims, 3 Drawing Sheets

DE-COKING TOOL

BACKGROUND OF THE INVENTION

The present invention relates to a tool for disintegrating coke.

In oil refineries, the last, otherwise unusable fraction of the crude oil is transformed into coke. This transformation is performed by feeding this fraction into drums which are filled with coke as the operation proceeds. Once the maximum filling level of the drums has been reached, the coke is cut out from the drums.

This so-called "de-coking" is usually carried out using high-pressure water jets which disintegrate the coke and wash it out of the drums. The tool for generating these high-pressure water jets is inserted into the drums from the top using a drilling rig. The de-coking is carried out in two stages. First, an opening in the drum is cut from the top to the bottom, then the tool is raised back to the top of the drum, and the coke is then disintegrated by the high-pressure water jets generated by cutting nozzles at about right angles to the axis of the bore.

The tool is adapted to assume two operating states, one for drilling an opening needed for moving the tool and then letting the disintegrated coke exit, and one for cutting the coke across the cross-section of the drum. The drilling nozzles accordingly send high-pressure water jets essentially parallel, or at an oblique angle, to an axis formed by the drill stem and the opening arising from the drilling. The cutting nozzles, on the other hand, generate high-pressure water jets aligned essentially at right or obtuse angles to the axis formed by the drill stem and the opening in the drum.

The switch-over between the operating states of drilling and cutting has to be quick and simple. The nozzles used in the tool are subject to wear and tear due to the high water pressure and thus have to be replaced frequently. Therefore, the tool must be adapted in such a way that the replacement of the nozzles can be carried out in a quick and safe manner.

SUMMARY OF THE INVENTION

The object of the present invention is to provide a tool for disintegrating coke which is particularly simple and safe to use and maintain.

The above object is achieved by a tool having the characterizing features of claim 1. Tools for disintegrating coke with a housing, which is attached to a drill stem in operation and having at least one nozzle for cutting and drilling coke and at least one valve for closing and opening the nozzles arranged on it, are known from the state of the art. These tools are adapted to have two different operating states. The at least one valve closes off the cutting nozzles in the "drilling" operating state, while in the "cutting" operating state, the drilling nozzles are closed off by the at least one valve. The housing, the valve and the nozzles in these tools are formed in such a way that unhindered passage of water from the drill stem through the housing and the valve and through the nozzles not closed off by the valve is ensured.

The design of such a tool is greatly simplified when the nozzles to be closed off, depending on each chosen operating state, are closed off by a ball valve. Combinations comprising a ball valve for opening and closing drilling nozzles and other means for opening and closing cutting nozzles are well known, but they need a multitude of parts and result in a tool with a complex structure.

The present invention is advantageous in that the number of parts is reduced and that it is completely ensured that there is only ever one nozzle or group of nozzles that is closed off and the other nozzle or group of nozzles is open.

The tool comprises a valve which has a valve carrier in engagement with the balls for closing off the nozzles. The valve further includes associated means for guiding the ball and positioning aids, as necessary, by means of which the balls are held in predetermined positions. An apparatus for operating the valve is also associated with the valve. The valve is arranged in the housing of the tool and when operated is flown through or around by the water used to remove the coke.

The balls of the ball valve are guided in the valve carrier by suitable means for guiding balls. One possibility would be to provide means for guiding at the valve carrier. These could be, for example, concave shells or guiding grooves or guiding protrusions in engagement with the balls. Alternatively, an arrangement is possible where the balls associated with the valve carrier are positioned by springs in the positions suitable for each operating state. The means for guiding could therefore either be formed integral with the valve carrier or formed independent of it. The latter embodiment then cooperates with the ball and the valve carrier for guiding the ball. The means for guiding may also be comprised of a plurality of parts, for example a recess or groove in the valve carrier cooperating with a spring arrangement in order to guide the balls.

The balls may be completely spherical. It is, of course, entirely possible for the balls to be spherical only in segments where in an operating state they close off the entry to a nozzle. The spherical form of this surface area ensures that the entry to each nozzle to be closed off is securely sealed against the passage of liquid. A circular disk, one side of which is spherically domed would, for example, be quite sufficient for the purpose of closing the nozzle. This is why bodies that are not entirely spherical in shape will also be referred to as "balls" in the sense of the invention.

Preferably, the balls are symmetrical bodies having at least two spherical surface sections. Usually, these spherical surface sections are opposite to each other, e.g. as calottes, whose maximum circumferences are adjacent to each other. These symmetrical balls have the advantage that on the one hand, because of the symmetry, they are easily guided by the means for guiding. On the other hand, they are advantageous in that, should the first spherical surface section show signs of being worn out, the symmetrical ball could simply be flipped over. Thus, a different calotte with a second spherical surface section could be used for sealing off the nozzle. The symmetrical ball is usually preferred over the completely spherical ball since, if tools are to be designed with a reduced diameter, the symmetrical balls have a smaller thickness, with reference to the diameter of the tool, than completely spherical balls.

According to a first embodiment, the valve carrier is integrated in the housing in such a way that it is a part of the exterior wall of the tool. According to a second embodiment, the valve carrier is mounted within the housing. The means for guiding the ball and the valve carrier, if necessary, are arranged in the housing of the tool, although they usually do not quite fill it. There are thus gaps between the means for guiding the balls and the valve carrier and the housing. According to an advantageous further development of the invention, these gaps are in communication with the interior cavity of the tool so that in operation the liquid flowing through the tool can also flow through these gaps. The advantage of this arrangement is that there are no pressure differentials within the tool between the interior cavity and the gaps between the housing and the valve carrier. Material savings may thus be realized when designing the valve carrier because no pressure differentials, with their associated pressure and pulling forces, must be absorbed. Additionally, the avoidance of pressure differential ensures smooth operation of the ball valves.

A particularly preferred embodiment of the tool according to the present invention, comprises a valve carrier, in which the nozzles for cutting are arranged in two or more levels one on top of the other. This greatly enhances the power of the tool. Preferably, the nozzles are offset from each other in the several levels.

The switch-over from the "drilling" operating state to the "cutting" operating state is carried out manually in most of the prior art tools. The tool is retracted from the drum after the first processing step and a device within the tool is operated, which after completion of the drilling closes off the drilling nozzles directed to the bottom and opens the cutting nozzles.

This device for closing individual, or a plurality of nozzles is operated by means which on the one hand engage the apparatus for closing and on the other hand involve an operating member operable from the outside of the tool. This operating member is always positioned below the tool with prior art de-cooking tools. Arrangements for switching over a de-coking tool according to this design may be robust and well proven. However, they have a particularly serious drawback in that the tool must be completely retracted from the drum, and that for switching over from "drilling" to "cutting", the cutting nozzles must be at the body height of the operating personnel. In some cases, this can result in heightened risks for the operating personnel, such as when, as has been known to happen, the controlling mechanism fails.

The first approach to avoid this drawback has been to develop automatic arrangements for switching over de-coking tools. This has been problematic, however, since it is difficult to attach the relatively sensitive control mechanisms to the tool which is used in a very harsh environment subject to extreme mechanical and thermal stresses and strains.

The arrangement of the means for operating the apparatus within the de-coking tool for closing off individual, or a plurality of, nozzles, so that the operating member is arranged between the nozzles and the top end of the tool, already ensures that accidents with a manually operable arrangement for switching over may be avoided. This arrangement is considered independent, novel and inventive and suggests a simple and safe tool for disintegrating coke.

With the preferred arrangement, the tool can remain within the drum to be emptied, when the operating state is to be changed from the first to the second, or vice-versa, to such an extent that the cutting nozzles from which high-pressure water jets exit remain covered by the drum. Even for the case where the control devices of the de-coking plant fail, or if it is (erroneously) signaled that the tool can be switched over although high pressure remains applied to it, the operating personnel may approach the tool without the risk of getting hurt by high-pressure water jets.

The apparatus for closing individual, or a plurality of, nozzles have different forms. Some tools are provided with ball valves, other tools have hollow cylinders provided with cut-outs for opening the nozzles. Depending on the position of the cylinder, also connected to a bottom plate provided with cut-outs, as necessary, a high-pressure water jet exits, or the respective nozzle is closed off by the hollow cylinder or the bottom plate. Herein the hollow cylinder covers the cutting nozzles or exposes them, while the bottom plate exposes or closes the drilling nozzles, respectively.

For virtually all of the prior art apparatuses it is possible to provide an arrangement for switching-over the de-coking tool wherein the operating member is upstream of the nozzles and therefore at the top end of the de-coking tool.

It is considered particularly advantageous that existing and, as far as the apparatus for closing off individual, or a plurality of, nozzles is concerned, well proven facilities may be equipped with the arrangement according to the invention.

BRIEF DESCRIPTION OF THE DRAWINGS

A preferred embodiment of the present invention will now be described in detail in the following with reference to the accompanying drawings, wherein.

DETAILED DESCRIPTION

Figure 1:
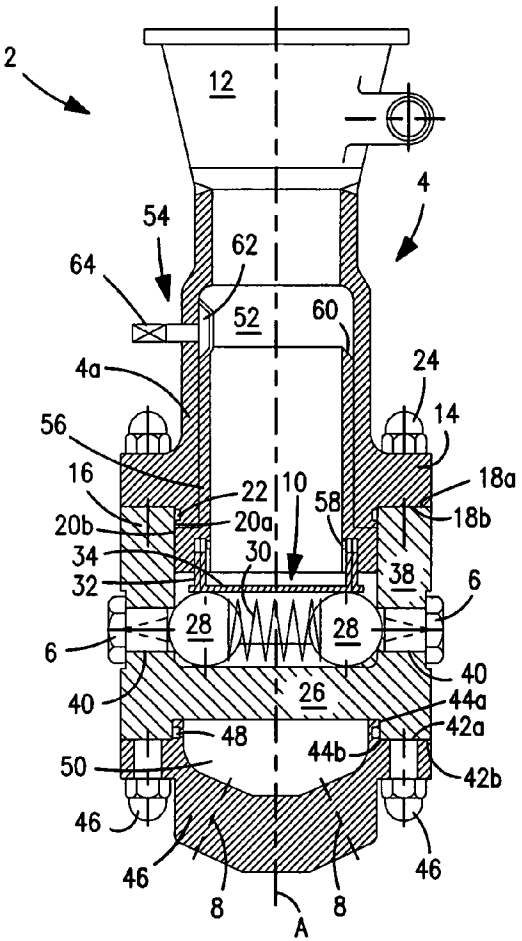
FIG. 1 shows a longitudinal sectional view of an embodiment of the tool of the present invention in the "drilling" operating state.

FIG. 1 shows tool 2 with a housing 4, two nozzles 6 for cutting coke and two more nozzles 8 (schematically shown) for drilling coke and a valve 10 for opening and closing nozzle 6, 8.

In operation, tool 2 is attached to a drill stem (not shown) and is inserted in a drum filled with coke. Indications such as "top" and "bottom" refer to axis A of the tool shown in FIGS. 1 to 4 aligned with the drill stem (top) and a hole to be made by the tool (bottom; not shown).

Housing 4 is made of two parts. Valve 10 is arranged between the top housing half 4*a* arranged at the drill stem (not shown) and the bottom housing half 4*b*. Top housing half 4*a* is attached to the drill stem via a flange 12 from where it extends as an essentially hollow body to bottom housing half 4*b*. At the end of top housing part 4*a* associated with valve 10, a circular support 14 is integrally formed. At this support 14 a valve carrier 16 is disposed on the bottom.

For simple and precise alignment of valve carrier 16 at support 14, corresponding contacting surfaces 18*a* and 18*b*, and 20*a* and 20*b* are provided at support 14 and valve carrier 16. In the area of contacting surfaces 20*a*, 20*b*, a circular sealing ring 22 is provided.

Valve carrier 16 is bolted to support 14 using bolts engaging threaded bores (not shown) in support 14 and in valve carrier 16.

Valve carrier 16 is a cylindrical hollow body in which an intermediate web 26 is formed extending essentially at right angles to axis A. Two balls 28 of ball valve 10 are arranged to run on the web 26. Balls 28 are positioned at the outer periphery of web 26 or valve carrier 16. In this position they are held both during the "drilling" and "cutting" operating states, and during a switch-over from one operating state to the other, by positioning aids. In the present embodiment, the positioning aid is formed as a spring 30 exerting a force between the two balls 28.

The position of balls 28 on the web 26 is determined by the means for guiding the balls. These means for guiding the balls 28 are concave shells 32 in the present embodiment, embracing the top half of the balls 28 as well as spring 30. A guide 34 extents from concave shells 32 upwards.

Figure 2:
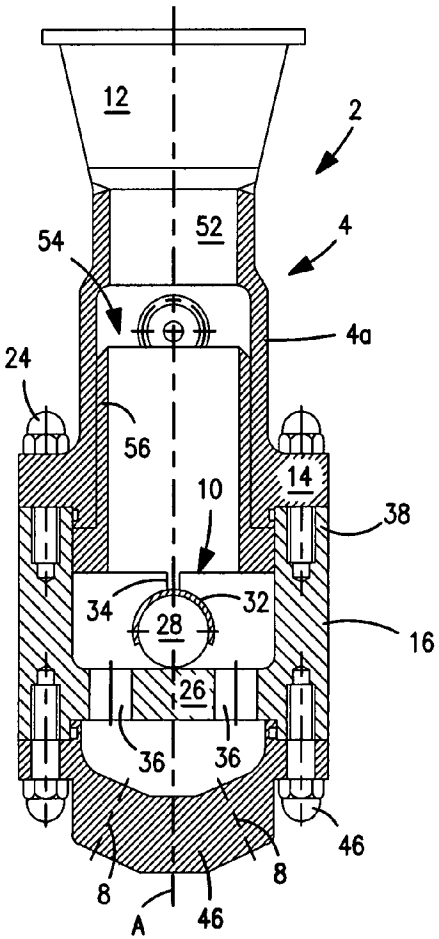
FIG. 2 shows a second longitudinal sectional view of an identical embodiment of the tool according to the present invention in the "drilling" operating state, at an angle to the sectional view of FIG. 1.

Web 26 of valve carrier 16 comprises bores 36, as shown in FIG. 2, whose number is equal to the number of balls 8. Valve carrier 16 has bores 40, into which cutting nozzles 6 are inserted, at its outer wall 38.

Below the web 26 or at its bottom surface, contacting surfaces 42*a* and 42*b*, and 44*a* and 44*b* are provided. Contacting surfaces 42*a,b* are parallel to axis A while contacting surfaces 44*a,b* are vertical to axis A.

The bottom housing half 4*b* contacts these contacting surfaces 42*a,b* and 44*a,b* and is attached to the valve carrier by bolts 46 which engage threaded bores (not shown) of valve carrier 16. In the area of contacting surfaces 44*a,b*, a circular sealing ring 48 is provided.

A cavity 50 in the bottom housing half 4*b* ensures that liquid can pass unhindered through bores 36 to drilling nozzles 8 positioned in the bottom housing half 4*b*. Drilling nozzles 8 are only schematically shown.

The tool 2 shown in FIGS. 1 and 2 is in the "drilling" operating state (drilling state). In the drilling state, balls 28 of ball valve 10 block bores 40 in the outer wall 38 of valve carrier 16. The diameter of balls 28 is such that bores 40 are reliably and completely covered.

At the same time, as shown in FIG. 2, bores 36 in web 26 of valve carrier 16 are left free. Water entering tool 2 at high pressure from the drill stem, flows through the interior 52 within the tool above web 26, through bores 36, passes through cavity 50 in the bottom housing half 4*b*, and then exits through nozzles 8 into a drum filled with coke (not shown).

To switch over from the drilling state into the "cutting" operating state, an apparatus 54 for operating valve 10 is provided at tool 2. Apparatus 54 comprises a cylindrical hollow body 56 inserted in the top housing half 4*a*. The bottom end of this hollow body 56 has recesses 58 in engagement with guides 34 of ball valve 10. The top end 60 of hollow body 56 is formed in the manner of a gear rim. A gear 62 is in mesh with said top end 60 of hollow body 56 formed in the manner of a gear rim. An axle 64 is attached to gear 62 extending through top housing half 4*a*. Axle 64 is manually adjusted using a wrench.

To switch over from the drilling state to the "cutting" operating state, gear 62 is operated by turning axle 64. Hollow body 56 in mesh with gear 62 is rotated within the top housing half 4*a* by gear 62. Guide 34 and with it balls 28 of ball valve 10 are rotated together with hollow body 56. By rotating balls 28 on valve carrier 16, bores 40 that had closed off nozzles 6, are now exposed (cf. FIG. 3). By operating handle 64, balls 28 move on a circular path until bores 36 are completely closed off (cf. FIG. 4).

Figure 4:
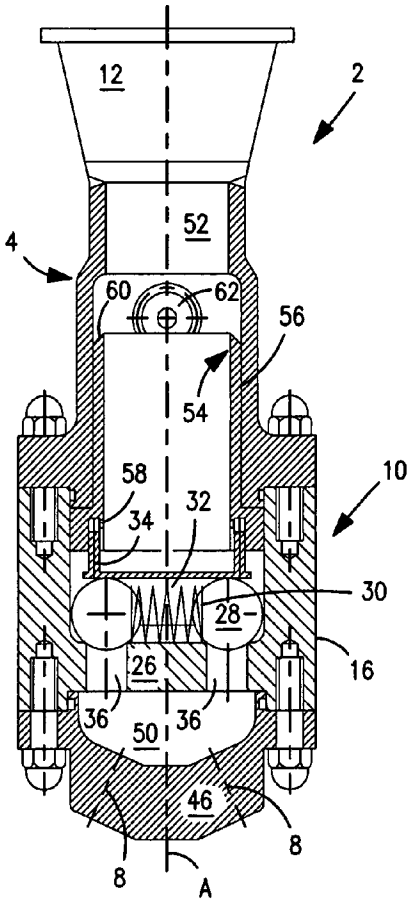
FIG. 4 shows a second longitudinal sectional view of an identical embodiment of the tool according to the invention in the "cutting" operating state, at an angle to the sectional view of FIG. 3.
Figure 3:
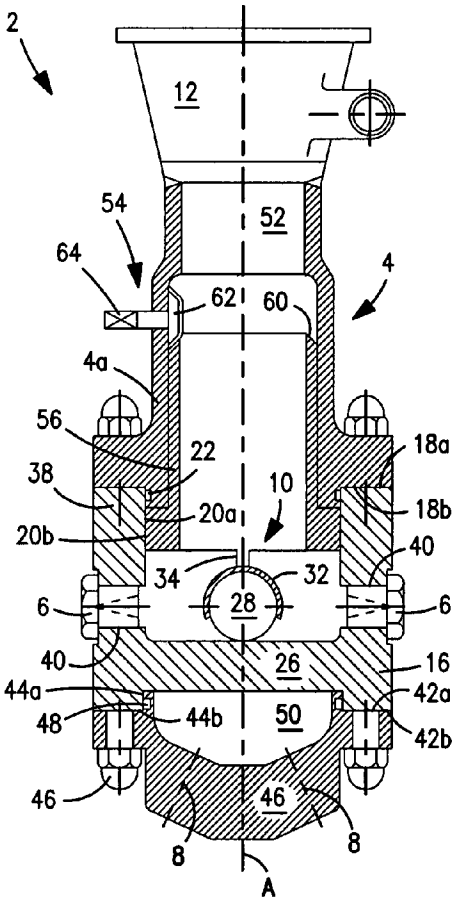
FIG. 3 shows a longitudinal sectional view of an embodiment of the tool of the present invention in the "cutting" operating state.

FIGS. 3 and 4 show a tool 2 in the cutting operating state. Water at high pressure flows from the drill stem into interior 2 of the top housing half 4*a* and exits from the cutting nozzles, the only possible outlets, at about right angles to axis A. Bores 36 are safely and completely blocked by balls 28 positioned on top of them. The closing action of balls 28 is additionally secured in this position and, likewise, when bores 40 are blocked by the fact that the extremely high pressure of the water, far above 100 bars, presses the balls to the valve carrier.

The exemplary embodiment shown in FIGS. 1 to 4 concerns an embodiment of the invention with two nozzles 6 for cutting and two nozzles 8 for drilling. However, embodiments are also covered by the subject matter of the invention with three or more nozzles 6 or nozzles 8, respectively. Neither is it necessary for the numbers of nozzles 6 and of nozzles 8 to be equal. In particular with embodiments of the invention having three or more nozzles requiring more than two balls 28, a separate guide for each ball may serve as a positioning aid. Spring 30 is then no longer needed.

Figure 5:
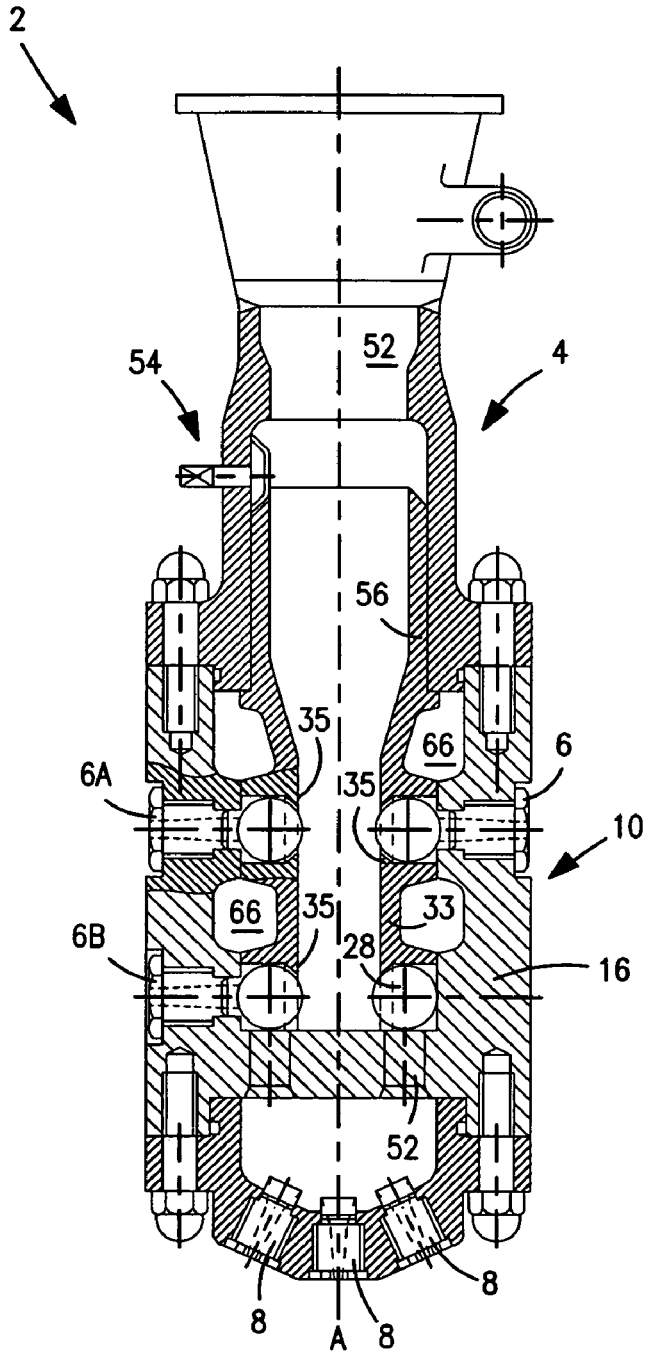
FIG. 5 shows a sectional view of a tool according to a second embodiment.

Such an embodiment of tool 2 having a plurality of nozzles is shown in FIG. 5 (equivalent features are designated with identical reference numerals). Tool 2 has a housing 4 and a valve 10. Valve carrier 16 is inserted in the housing. Cutting nozzles 6 as shown in FIG. 5 are arranged in two levels, one on top of the other. Nozzles 6A and 6B are shown to be vertically aligned, whereas in fact they are offset at an angle of about 60° to each other. This is indicated by cross-hatching.

Balls 28 opening or closing, depending on the operating state, nozzles 6 and openings 36 supplying drilling nozzles 8, are received in means for guiding, which fix balls 28 in predetermined positions and act as a support 33 together with guiding protrusions 35 integral with it. Support 33 is attached to cylindrical hollow body 56 as part of apparatus 54 for operating valve 10. Guiding protrusions 35 effect a secure positioning of balls 28 so that no springs are needed. Apparatus 54 for operating the valve otherwise corresponds to the embodiments shown in FIGS. 1 to 4.

Between housing 4, valve carrier 16 and the means 33 for guiding the balls 28, there are gaps 66 in flow communication with interior cavity 52. In operation, the water flowing through tool 2 therefore flows both through interior cavity 52 and through gaps 66 so that any pressure differentials are avoided.

What is claimed:

1. A tool for disintegrating coke, comprising:

a housing attached to a drill stem;

at least one cutting nozzle for cutting coke;

at least on drilling nozzle for drilling coke;

at least one ball valve having balls in the housing for opening and closing said at least one cutting nozzle and said at least one drilling nozzle, wherein said tool is adapted to operate in a drilling operating state wherein said balls close said at least one cutting nozzle and water may flow unhindered from said drill stem through said housing, said ball valve and said at least one drilling nozzle, and in a cutting operating state wherein said balls close said at least one drilling nozzle and water may flow unhindered from said drill stem through said housing, said ball valve and said at least one cutting nozzle.

2. The tool of claim 1, wherein said at least one ball valve comprises balls which are at least partially spherical in shape.

3. The tool of claim 2, wherein said balls have at least two spherical surface sections.

4. The tool according to claim 2, wherein said balls are symmetrical.

5. The tool of claim 2, wherein said balls are held in position by a spring.

6. The tool of claim 2, wherein said balls engage means for guiding.

7. The tool of claim 6, wherein said means for guiding said balls of said at least one ball valve comprise concave shells embracing said balls.

8. The tool of claim 1, wherein said at least one ball valve engages means for operating said at least one ball valve for switching over from said cutting operating state to said drilling operating state.

9. The tool of claim 6, wherein said means for guiding said balls have a guide engaging means for operating said valve.

10. The tool of claim 1, further comprising a valve carrier arranged in said housing, defining a gap between said housing and said valve carrier, wherein said gap is in flow communication with an interior cavity of said tool.

11. The tool of claim 10, wherein at least two cutting nozzles for cutting are inserted in cutting bores of the housing and at least two drilling bores are arranged in web of the valve carrier of said at least one ball valve, and wherein the at least two drilling bores are blocked by said at least one ball valve when said tool is in said cutting operating state, and said cutting bores are blocked by said at least one ball valve when said tool is in said drilling operating state.

12. The tool of claim 11, characterized in that said at least two cutting nozzles are arranged one on top of the other.

13. The tool of claim 1, further comprising means for operating said at least one ball valve, wherein said means for operating are arranged between said cutting and drilling nozzles and a top end of said tool.

* * * * *

UNITED STATES PATENT AND TRADEMARK OFFICE

CERTIFICATE OF CORRECTION

PATENT NO. : 7,163,165 B2
APPLICATION NO. : 10/484571
DATED : January 16, 2007
INVENTOR(S) : Wolfgang Paul, Dirk Heidemann and Maciej Barcikowski It is certified that error appears in the above-identified patent and that said Letters Patent is hereby corrected as shown below:

Title page:
Item (75) Inventors, delete “Bareikowski” and insert --Barcikowski--.

Column 7,
Line 14, delete “in web” and insert --in a web--.

Signed and Sealed this

Thirty-first Day of July, 2007

JON W. DUDAS
*Director of the United States Patent and Trademark Office*